US005551189A

United States Patent [19]

Westfall

[11] Patent Number: 5,551,189

[45] Date of Patent: Sep. 3, 1996

[54] HURRICANE WINDOW BRACE

[75] Inventor: Norman R. Westfall, Rochester, N.Y.

[73] Assignee: Caldwell Manufacturing Company, Rochester, N.Y.

[21] Appl. No.: 264,474

[22] Filed: Jun. 23, 1994

[51] Int. Cl.[6] ..... E05D 15/22

[52] U.S. Cl. ..... 49/76; 49/181; 49/419; 52/204.5; 52/213

[58] Field of Search ..... 49/440, 441, 414, 49/419, 181, 176; 52/204.5, 204.51, 213

[56] References Cited

U.S. PATENT DOCUMENTS

| | | | |
|---|---|---|---|
| 2,000,564 | 5/1935 | Howenstein | 49/419 |
| 2,965,935 | 12/1960 | Olsen | 52/204.5 |
| 3,335,523 | 8/1967 | Isler et al. | 49/176 X |
| 3,529,381 | 9/1970 | Grossman | 49/176 X |
| 3,724,131 | 4/1973 | Schnormeier | 49/181 |
| 4,683,676 | 8/1987 | Sterner, Jr. | 49/176 x |
| 4,922,657 | 5/1990 | Foss | 49/176 X |
| 4,930,254 | 6/1990 | Valentin | 49/176 X |
| 5,243,783 | 9/1993 | Schmidt et al. | 49/176 X |
| 5,251,401 | 10/1993 | Prete et al. | 49/181 |

*Primary Examiner*—Wynn E. Wood
*Attorney, Agent, or Firm*—Eugene Stephens & Associates

[57] ABSTRACT

A hurricane window brace arranges brace elements at upper corners of a tilt sash so that the brace elements extend from a plow region of the sash into inside corners of a shoe channel in a resin jamb supporting the sash. When so positioned, the braces maintain a distance between the inside corners of the shoe channels and the plow regions of the sash so that the upper corners of the sash cannot be moved or tilted inward by wind force. Moving the braces upward or laterally, when wind force resistance is not required, allows the sash to tilt.

18 Claims, 3 Drawing Sheets

HURRICANE WINDOW BRACE

TECHNICAL FIELD

The invention involves the wind force resistance bracing of windows with tilt sash running in resin jambs.

BACKGROUND

Wind force resistance of windows with tilt sash is often a problem, because a tilt sash is designed to tilt inward in the same direction that wind force drives against the sash. If the wind resistance of the sash is made especially strong, the sash will be difficult to tilt; and if the sash is made easy to tilt, it may also yield too readily to wind force. Sweep locks at check rail level can greatly increase the wind force resistance of a tilt sash that is closed and locked; but even with the assistance of check rail locks, tilt sashes can blow inward when buffeted by hurricane force winds, because the jambs for tilt sash offer less wind force resistance along the stile edges of the sash.

The wind force resistance problems of tilt sash have been difficult to solve because of the conflict between the need for easy tilting convenience and strong wind resistance. The problem also becomes more severe as tilt windows are required to provide increasingly strong wind resistance so that they can be certified not to fail in high winds. The many attempts that have been made to solve the wind resistance problems of tilt sash have not yet proved satisfactory at meeting the needs of high wind resistance at a low cost without interferring with the ease and convenience of operating the window.

SUMMARY OF THE INVENTION

My hurricane window brace solves these problems by arranging simple and inexpensive brace elements at the upper corners of a tilt sash to brace against inside corners of shoe channels in the jamb so that the brace elements give the sash greatly increased resistance to inward movement. The brace elements are also arranged to be movable from a bracing position to allow the sash to tilt. This can be done in several ways, including making the brace elements movable vertically in the jamb or movable laterally outward to clear a jamb path for the sash to tilt. When in bracing position, though, the bracing elements extend from upper plow regions of the sash into corners of shoe channels in the jambs at bracing angles that are effective at strongly resisting wind forces tending to move the sash inward.

DRAWINGS

Figure 2:
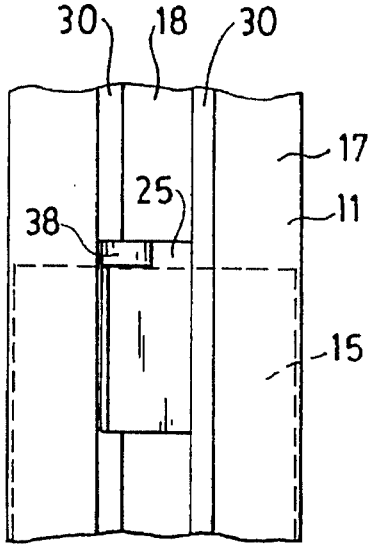
FIG. 2 is a side view of the right-hand jamb of the window of FIG. 1 with the sash position shown in broken lines.
Figure 3:
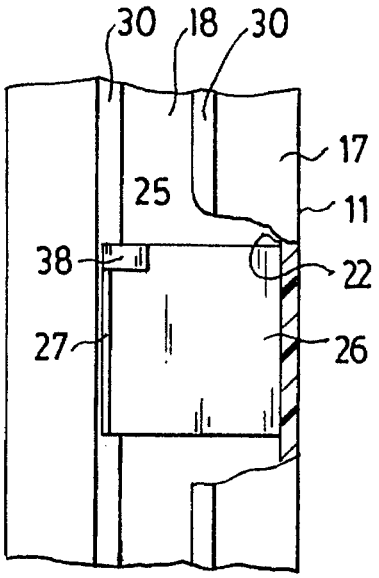

FIG. 3 a side view similar to the view of FIG. 2 with part of the jamb cut away to show the bracing of a brace element against an inner corner of a shoe channel.

Figure 1:
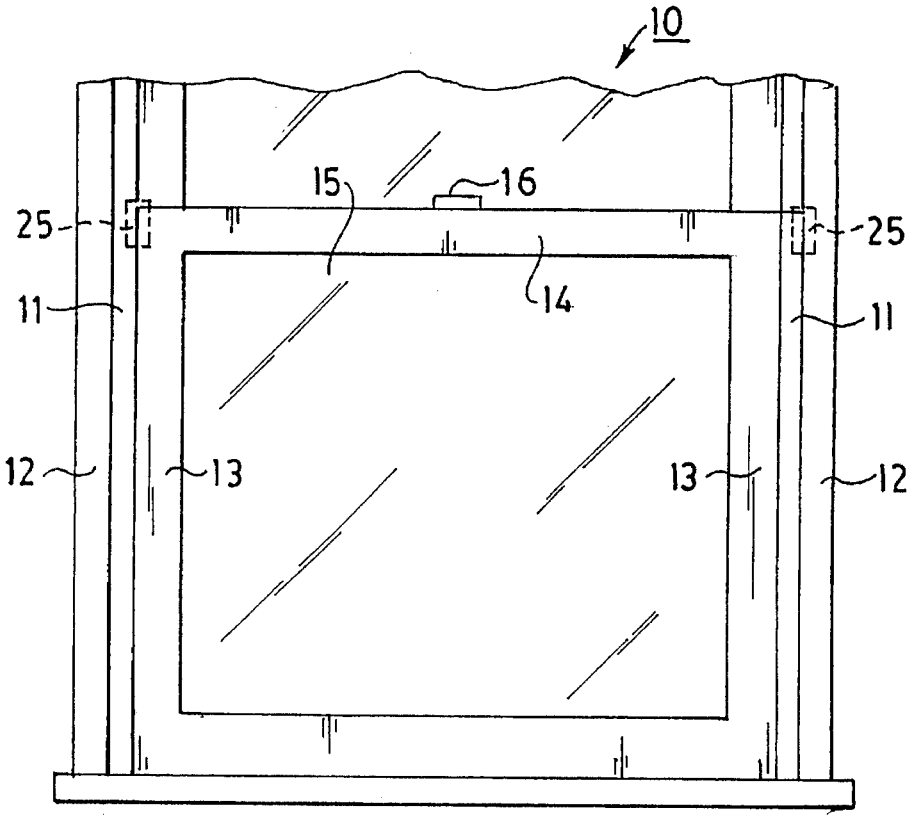
FIG. 1 is a partially schematic front view of a tilt sash mounted between resin jambs and having brace elements according to the invention shown in broken lines at upper corners of a tilt sash.
Figure 4:
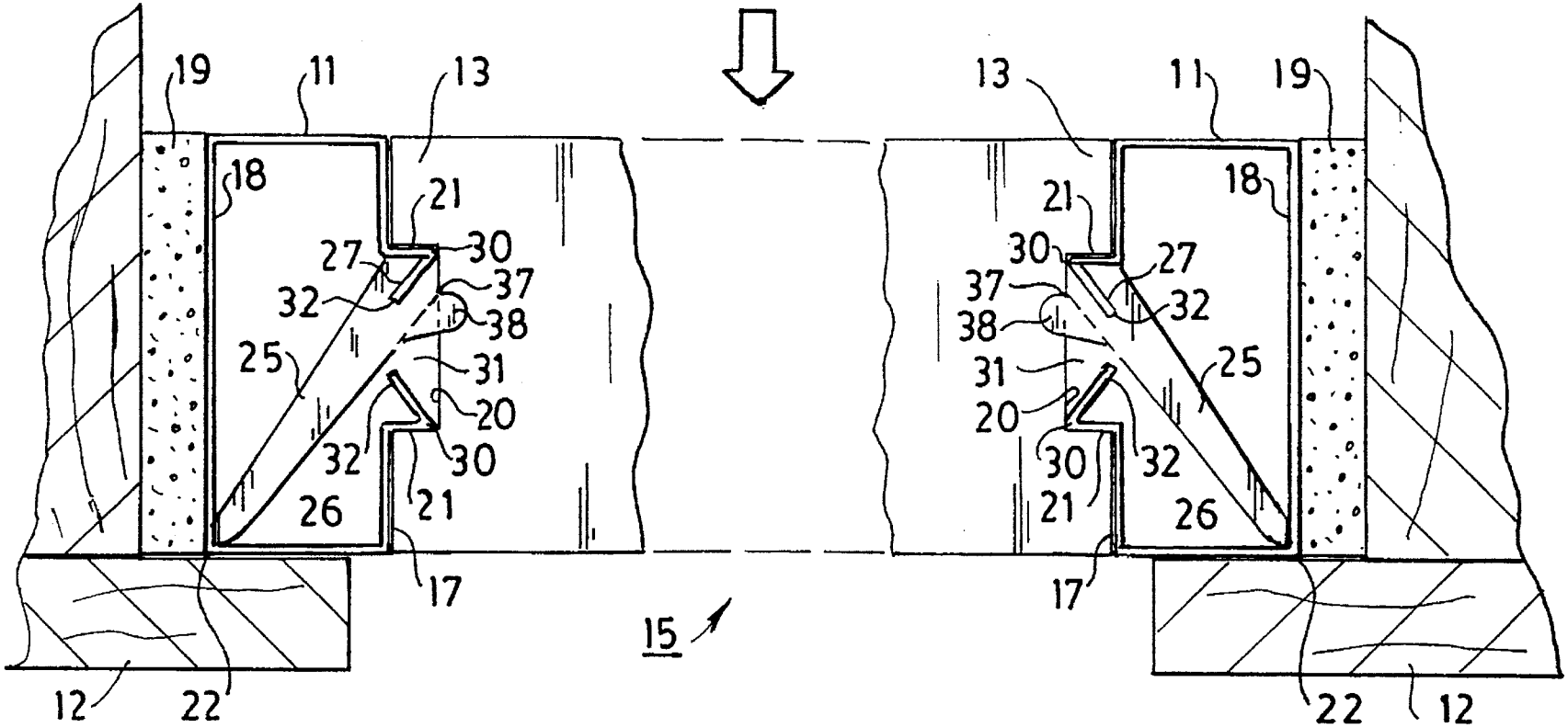

FIG. 4 is a partially schematic and partially cut away top view of the sash of FIG. 1 showing brace elements arranged for bracing the sash against wind force, which is represented by an arrow.

Figure 5:
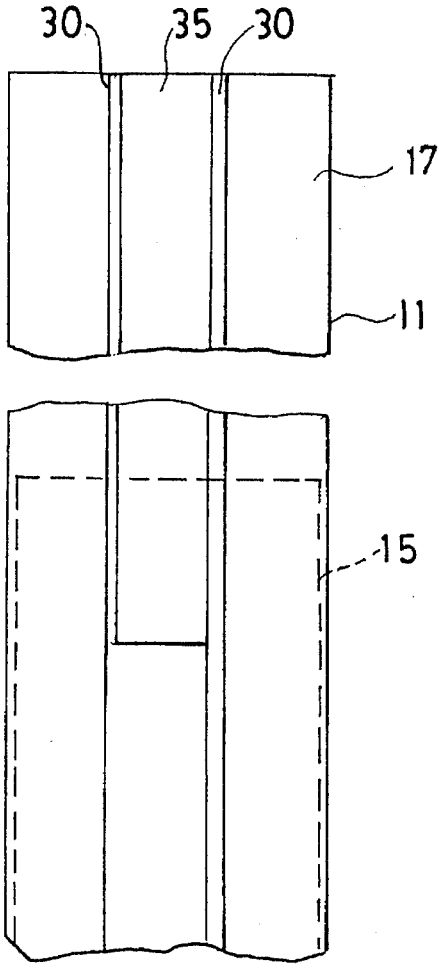

FIG. 5 is similar to FIG. 2 in showing a side view of a jamb provided with an elongated bracing element arranged for closing a jamb slot above the closed position of a sash, which is show broken lines.

Figure 6:
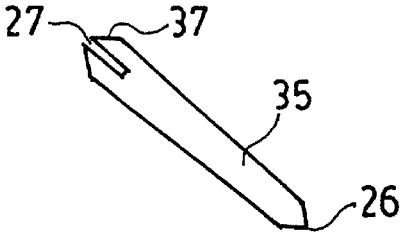

FIG. 6 is an end view of the elongated brace element of FIG. 5.

Figure 7:
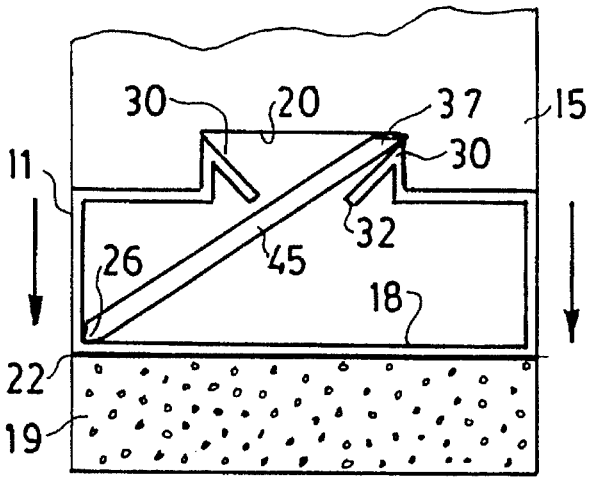

FIG. 7 is a partially schematic, fragmentary view of a form of brace element arranged for moving laterally outward to allow a sash to tilt.

DETAILED DESCRIPTION

The hurricane window brace of this invention exerts a bracing action on the upper, corners of a tilt sash 15 arranged in a window 10. Sash 15 runs between resin jambs 11 arranged within window 10 behind trim strips 12. Sash 15 has stile edges 13 and a top or check rail 14. It can be arranged in a double-hung or single-hung window 10.

Brace elements 25, as shown in FIGS. 1–4, are arranged at upper regions of stiles 13 at the level of check rail 14 for bracing tilt sash 15 against wind force that is shown by the arrow in FIG. 4. Braces 25 engage jambs 11 and obliquely brace against tilt sash 15 as explained more fully below, for resisting wind force. Sweep lock 16 on check rail 14 preferably assists by locking sash 15 in a closed position while brace elements 25 brace the upper corners of sash 15.

Jambs 11 include sash run surfaces 17 engaged by the outer edges of stiles 13 of tilt sash 15 and shoe channels 18 containing counterbalance shoes and a counterbalance spring system (not shown). Jambs 11 are made resilient enough to move laterally away from the edges of stiles 13 to allow sash 15 to tilt, and such resilience can be provided in several ways. One simple way illustrated in the drawings is a resilient foam backing 19 that allows jambs 11 to move laterally, but other resilient or spring arrangements are also possible.

Otherwise, jambs 11 retain sash 15 in a vertical orientation for movement up and down when sash 15 is not tilted. The retainer system between sash 15 and jambs 11 involves a grooved plow region 20 in sash stiles 13 and a pair of guide ribs 30 extending into sash plow 20 from the plane of sash run 17. Guide ribs 30 are arranged on opposite sides of a slot 31 that communicates between sash run 17 and shoe channel 18. Each guide rib 30 engages and runs along a side edge 21 of sash plow 20, and guide ribs 30 have inturned free edges 32.

Braces 25 have inner ends 26 that brace against inside corners 22 of shoe channels 18 adjacent trim strips 12. From inside shoe channel corners 22, braces 25 extend obliquely outward across slots 31 to the region of an outer one of the guide ribs 30. "Inner" or "inside" and "outer" or "outside" in this context refers respectively to the indoor side or room side of window 10 and the outdoor side or weather side of window 10.

In such an obliquely angled position, braces 25 extend between the outer sash plow edges 21 and inner shoe channel corners 22 and maintain a fixed distance between these two regions. Then, as long as jambs 11 remain mounted within window 10 behind trim strips 12 and braces 25 remain engaged with outer guide ribs 30 and outer edges 21 of sash plows 20, the upper corners of sash 15 are strongly braced against a wind force. Experience has shown that such a bracing arrangement can give Sash 15 adequate resistance against hurricane force winds, while remaining easy to tilt.

Braces 25, as shown in FIGS. 1–4, preferably have slots 27 that engage free end regions 32 of outer guide ribs 30. This helps locate braces 25 properly within plow regions 20 of sash 15, and it allows braces 25 to slide vertically in jambs 11 by riding up and down on guide ribs 30 while engaging inner corners 22 of shoe channels 18. A sash end 37 of braces 25 can extend deeper into plow region 20 than outer guide rib 30 so that braces 25 can have a more positive sash plow interlock than guide ribs 30.

The upper edges of the sash ends of braces 25 can have lips 38 that overlie check rail 14 at the upper stile corners of sash 15. By overlying the top of sash 15, lips 38 make braces 25 move upward when sash 15 is lifted. This positions braces 25 above the level of check rail 14 in the closed sash position shown in FIG. 1 and also moves braces 25 upward in jambs 11 where they are out of the way of tilting sash 15.

To prepare for a hurricane, sash 15 is closed and locked with lock 16, and braces 25 are moved down to the check rail level shown in FIG. 1 by pressing downward on lips 38. There, braces 25 are in,position to brace the upper corners of sash 15 strongly against high winds.

FIGS. 5–7 show other alternatives for a hurricane window brace according to the invention. Brace 35, as shown in FIGS. 5 and 6, is similar to brace 25 except for being elongated so that it extends l from the check rail level of closed sash 15 upward above sash 15, where it closes slot 31 between sash run 17 and shoe channel 18. Brace 35 can otherwise be similarly configured to brace 25 and can include inside corner 26, slot 27, and sash plow engaging region 37. Brace 35 does not need lip 38 and does not move upward with sash 15 or require movement back downward to be in bracing position for resisting high winds.

To allow sash 15 to tilt with elongated braces 35 in bracing position, it is necessary to move braces 35 laterally against the resilience of jambs 11 so that guide ribs 30 and braces 35 move clear of the plow region of sash 15 and allow sash 15 to tilt. Such lateral movement is schematically illustrated by the arrows in FIG. 7, indicating that jamb 11 can move laterally against a resilient element 19 to clear guide ribs 30 and brace end 37 from the plow 20 of sash 15. The brace 45 shown in FIG. 7 differs from braces 25 and 35, though, by having no slot 27 engaging a free edge 32 of guide rib 30. This is possible because brace 45 is elongated, like brace 35, and does not need to move up and down in jamb 11. A plow engaging end region 37 of brace 45 can rest on guide rib 30 and extend into plow 21 while brace corner 26 engages inside corner 22 of shoe channel 18. Brace end 37 moves aside of sash 15, with jamb ribs 30, to allow sash 15 to tilt.

The illustrated braces 25, 35, and 45 are all preferably molded of resin material so that they are inexpensive additions to window 10. Each brace element is preferably molded in a right- and left-hand configuration to fit respectively on right- and left-hand sides of tilt sash 15. The braces are preferably assembled with jambs 11 so that when the window frame is completed and sash 15 is installed between jambs 11, the hurricane braces are in position to resist wind force.

I claim:

1. In a tilt window having resin sash run surfaces communicating with a shoe channel via a slot edged by guide ribs engaging a plow region of a tilt sash, the improvement comprising:

a. a hurricane brace extending from an inside corner of the shoe channel obliquely outward to an outer one of the guide ribs, the brace being arranged for maintaining a fixed distance between the inside corner and a region of the sash plow engaged by the outer guide rib for strengthening the interconnection between a window jamb and the sash plow; and b. the brace being slidable along the shoe channel for movement vertically within the jamb so that the brace can be positioned at a check rail level to brace the window against wind force.

2. The improvement of claim 1 wherein the brace has a lip that overlies a top rail of the tilt sash so that when the tilt sash is raised, the brace slides up the jamb with the tilt sash.

3. The improvement of claim 1 wherein the brace is configured in right- and left-hand versions arranged respectively on opposite sides of the tilt sash.

4. The improvement of claim 1 wherein the brace is configured with a slot straddling a free end region of the outer guide rib.

5. The improvement of claim 1 wherein a sash end of the brace extends farther into the sash plow than the outer guide rib.

6. A hurricane window brace comprising:

a. a tilt sash running in resin jambs that have shoe channels and sash runs communicating via slots that are edged by guide ribs engaging plow regions of the tilt sash;

b. brace elements having inner edges braced against inner corners of the shoe channels;

c. the brace elements extending outward from the inner corners at oblique bracing angles across the slots to regions where outer ones of the guide ribs engage the plow regions of the tilt sash;

d. the brace elements being arranged at upper corner regions of the tilt sash when the sash is closed; and e. the brace elements being arranged for allowing the sash to open and tilt when the sash is not closed and braced against wind resistance.

7. The brace of claim 6 wherein the brace elements engage the outer guide ribs.

8. The brace of claim 7, wherein the brace elements are movable vertically within the jamb.

9. The brace of claim 6 wherein the jambs are resiliently mounted to allow the brace elements and the jambs to move away from the sash for allowing the sash to tilt.

10. The brace of claim 6 wherein the brace elements extend farther into the sash plows than the outer guide ribs.

11. The brace of claim 6 wherein the brace elements extend across the slots in regions above the sash.

12. A hurricane brace and a tilt sash, the felt sash having opposite stile sides running in a resin jamb formed with a shoe channel and a sash run that has a slot edged by ribs that engage plow regions of the tilt sash, the brace comprising:

a. a brace element arranged on each of the stile sides of the tilt sash;

b. each brace element engaging an inside corner of one of the shoe channels and extending obliquely outward from the shoe channel corner across the slot and into a region where an outer one of the slot ribs engages one of the sash plows;

c. the brace elements being arranged at upper corners of the tilt sash for bracing the upper corners against inward movement from wind force;

d. the brace elements being arranged for allowing the tilt sash to move vertically; and e. the brace elements being movable for allowing the sash to tilt.

13. The brace of claim 12 wherein the brace elements engage the outer slot ribs.

14. The brace of claim 13 wherein the brace elements have sliding engagements with the outer slot ribs and are configured for moving upward in the jamb when the tilt sash moves upward.

15. The brace of claim 12 wherein the brace elements extend across the slots in regions above the tilt sash.

16. The brace of claim 12 wherein the brace elements are formed in right- and left-hand configurations for fitting into the jambs on respective opposite sides of the tilt sash.

17. The brace of claim 12 wherein the brace elements are movable vertically for allowing the sash to tilt.

18. The brace of claim 12 wherein the brace elements are movable laterally for allowing the sash to tilt.

* * * * *